US005460138A

United States Patent [19]

Hasegawa

[11] Patent Number: 5,460,138

[45] Date of Patent: Oct. 24, 1995

[54] ENGINE BARRING SYSTEM

[75] Inventor: Kenji Hasegawa, Lafayette, Ind.

[73] Assignee: Caterpillar Inc., Peoria, Ill.

[21] Appl. No.: 202,523

[22] Filed: Feb. 28, 1994

[51] Int. Cl.[6] ..... F02B 77/00; F02N 15/10

[52] U.S. Cl. ..... 123/179.3; 123/198 R

[58] Field of Search ..... 123/179.3, 198 R, 123/179.1; 74/405

[56] References Cited

U.S. PATENT DOCUMENTS

| | | | |
|---|---|---|---|
| 1,887,998 | 11/1932 | Fageol | 123/195 A |
| 2,288,228 | 6/1942 | DeBlasse | 81/54 |
| 2,694,901 | 11/1954 | Schmidt et al. | 91/392 |
| 2,724,289 | 11/1955 | Wight | 74/625 |
| 2,879,673 | 3/1959 | Passman | 74/531 |
| 3,321,985 | 5/1967 | Wheeler | 74/325 |
| 3,395,588 | 8/1968 | Bleigh et al. | 74/405 |
| 4,072,063 | 2/1978 | Nauman | 74/405 |
| 4,580,534 | 4/1986 | Blum et al. | 123/179.1 |

FOREIGN PATENT DOCUMENTS

| | | |
|---|---|---|
| 0121698 | 10/1984 | European Pat. Off. . |
| 2445754 | 8/1980 | France . |
| 1914332 | 4/1970 | Germany . |
| 810815 | 3/1959 | United Kingdom . |

OTHER PUBLICATIONS

Service Publication—American Locomotive Co.—Jun. 1974—Engine Turning Arrangement—MI-11189B.

*Primary Examiner*—Andrew M. Dolinar
*Attorney, Agent, or Firm*—Dennis C. Skarvan

[57] ABSTRACT

An engine barring system is disclosed that includes a barring device having a drive shaft manually engageable with the flywheel of an engine to rotate the engine crankshaft. An electric motor is coupled to the drive shaft of the barring device and incrementally rotates the drive shaft in response to forward and reverse signals. A controller supplies the forward and reverse signals in response to manual input by a user. The controller is portable about the engine so that the user can incrementally advance or reverse the crankshaft while observing the crankshaft rotation away from the barring device. A reduction gear box is coupled between the motor and the barring device to reduce the drive shaft speed from the motor speed and also provide torque multiplication between the motor and drive shaft. The torque multiplication serves as an effective lock to prevent movement of the crankshaft when the barring device is engaged.

20 Claims, 4 Drawing Sheets

ENGINE BARRING SYSTEM

TECHNICAL FIELD

The present invention relates generally to engine maintenance and repair and, more particularly, to an engine barring system for use with large industrial engines that permits a user to observe and control engine crankshaft rotation away from the on-engine barring device.

BACKGROUND ART

Much of the repair and maintenance of large industrial engines must be performed "on location" at the engine installation due to the sheer size and weight of the engines. These engines range in size from 10 to 20 feet and upward in length and from 35,000 to 65,000 pounds and upward in weight. Many of the maintenance and repair procedures for these engines require positioning of the crankshaft and related components in a particular relationship relative to one another. Some maintenance or repair procedures further require access to the crankshaft; for example, during the removal of a connecting rod from the engine. Additionally, it is often required to incrementally rotate the flywheel to align the various couplings between the engine and generators, for example.

To rotate the crankshaft and connecting rod to a desired position, a manual barring device is typically provided at or near the flywheel of the engine that permits incremental rotation and, preferably, locking of the flywheel and crankshaft. A removable access panel fastened to the lower portion of the engine block permits a user to examine the crankshaft and its position, and repair or replace the connecting rod for example. However, due to the size of the engine, a user cannot simultaneously observe and manually advance or reverse the flywheel and crankshaft. Instead, the user must estimate the degree of rotation required while observing the crankshaft through the access port, then walk to the barring device and manually advance, or reverse, the flywheel the estimated degree of rotation. This procedure is repeated until the crankshaft is positioned at the desired degree of rotation.

What is needed is an engine barring system that permits a user to simultaneously observe and manually advance, or reverse, the rotation of the flywheel and crankshaft. Preferably, such a system would be powered, rather than manually wrenched by a user. Ideally, such a system would include an easily portable controller to control crankshaft rotation remote from the on-engine barring device.

DISCLOSURE OF THE INVENTION

According to one embodiment of the present invention, an engine barring system is disclosed for use with an engine during maintenance thereof, the engine including a starting system separate from the engine barring system, the engine barring system comprising a drive shaft including a plurality of gear teeth adapted for meshing with corresponding gear teeth of the engine drive train, the drive shaft being engageable with the engine drive train when the starting system of the engine is disengaged, motor means for incrementally rotating the drive shaft when the drive shaft is engaged with the engine drive train, the motor means incrementally rotating the drive shaft in response to a first signal, and means for controlling the motor means, the means for controlling supplying the first signal in response to a first manual input by a user.

According to another embodiment of the present invention, in an engine barring device for incrementally rotating a crankshaft of an engine during engine maintenance, the engine barring device including a drive shaft engageable with a flywheel connected to the crankshaft to rotate the crankshaft, the improvement is disclosed comprising an electric motor coupled with the drive shaft and a portable electronic controller remote from the electric motor, the electric motor incrementally rotating the drive shaft in response to a signal supplied by the electronic controller.

According to another embodiment of the present invention, an engine barring system is disclosed comprising a housing adapted for receipt mounted to an engine, a drive shaft movably disposed within the housing, the drive shaft being manually movable between an engaged position and a disengaged position for selectable engagement with the drivetrain of the engine during engine maintenance, a motor coupled to the drive shaft, the motor being adapted for incrementally rotating the drive shaft, and a controller remote from the motor, the controller being adapted for actuating the motor to rotate the drive shaft.

BEST MODE FOR CARRYING OUT THE INVENTION

Figure 1:
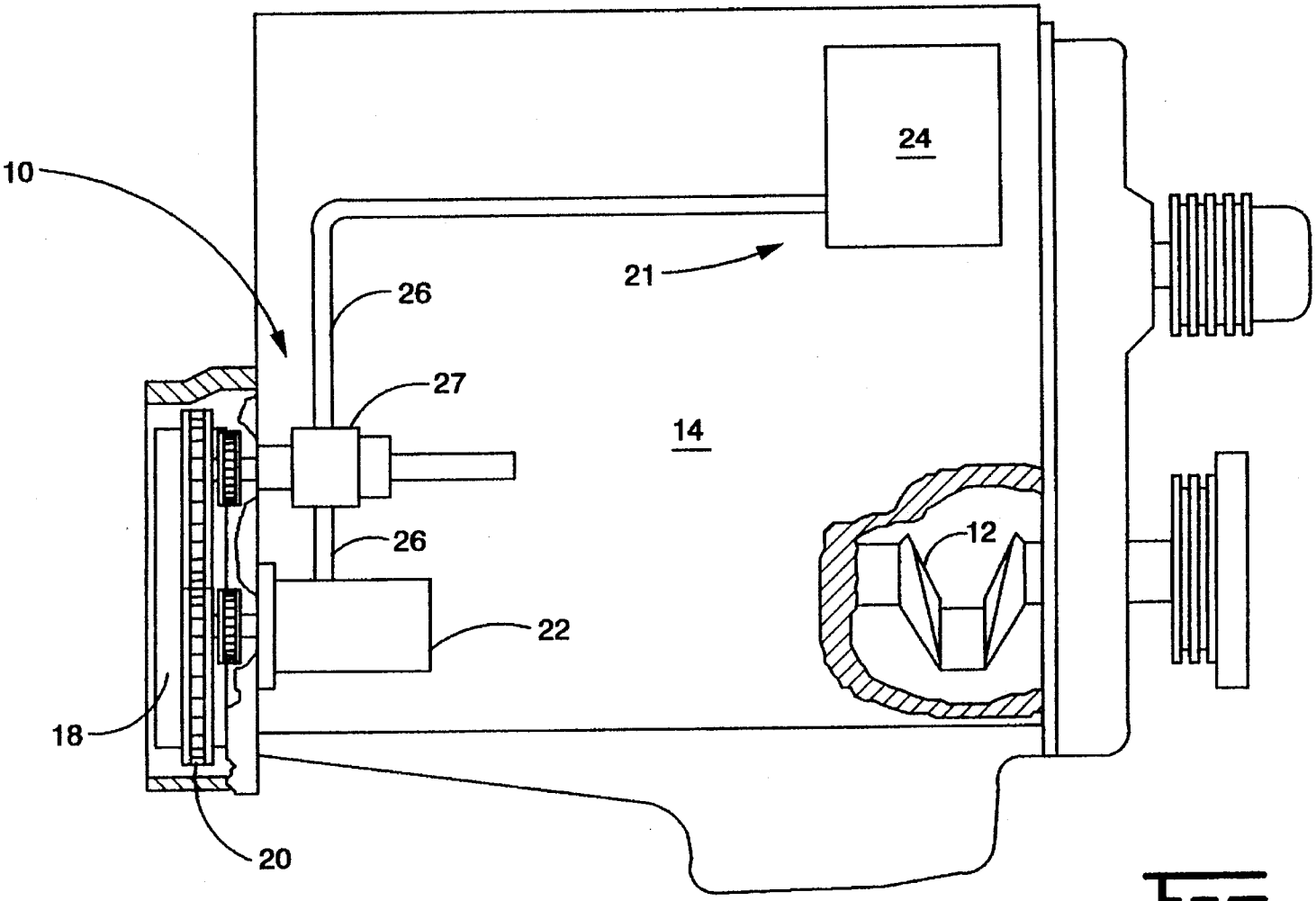
FIG. 1 is a schematic of an engine including an engine barring system according to one embodiment of the present invention.

Referring now to FIG. 1, an engine barring system 10 for rotating a crankshaft 12 of an engine 14 is shown. The engine 14 includes a flywheel 18 having a plurality of external teeth 20 thereon. The flywheel 18 is connected to crankshaft 12 in a conventional manner. A starting system 21 is typically provided for engine 14. Starting system 21 includes a starter motor 22 which is powered by either compressed air, pressurized hydraulic fluid, or electricity such as that provided by a compressor, hydraulic pump or battery, respectively. Barring system 10 is separate from starting system 21 and, preferably, includes means for preventing actuation of starter motor 22 when engine 14 is barred.

In the preferred embodiment, conduit means 26 conducts power between a power source 24 and starter motor 22 of system 21 via barring system 10. When in use, barring system 10 interrupts power conducted by conduit means 26 so that starting system 21 and barring system 10 cannot be simultaneously actuated. The means for preventing actuation of barring system 10 is preferably a function of the power required for starter motor 22. For example, in an electric powered starter the means for preventing actuation includes electronic switching means to disable an electronic circuit and prevent actuation of starter motor 22 when barring system 10 is in use, while in an air powered starter the means for preventing actuation includes mechanical valve means to disable a pneumatic circuit and prevent actuation of starter motor 22 when barring system 10 is in use.

Figure 2:
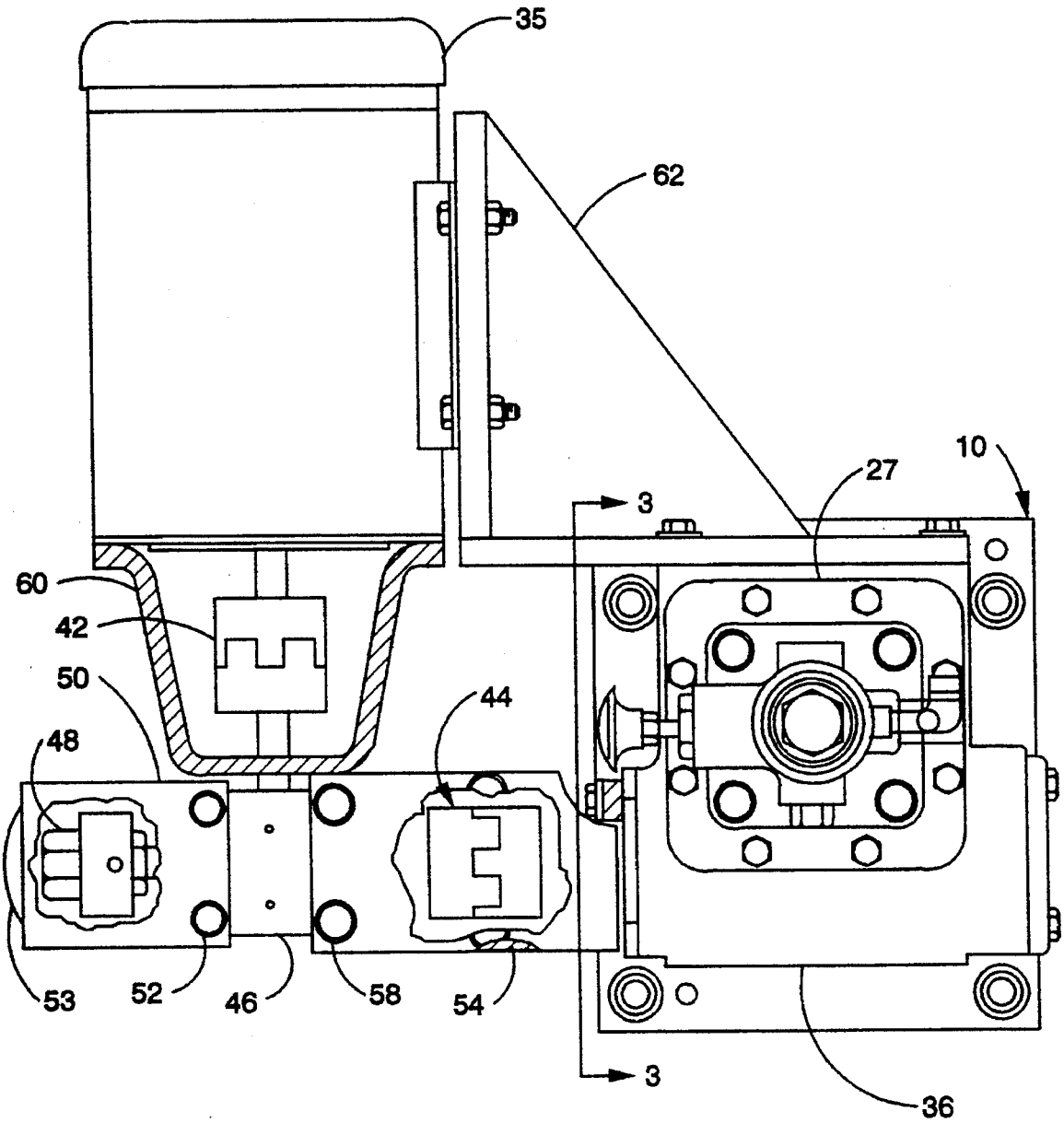
FIG. 2 is a side elevational, partial cross-sectional view of the engine barring system of FIG. 1.
Figure 3:
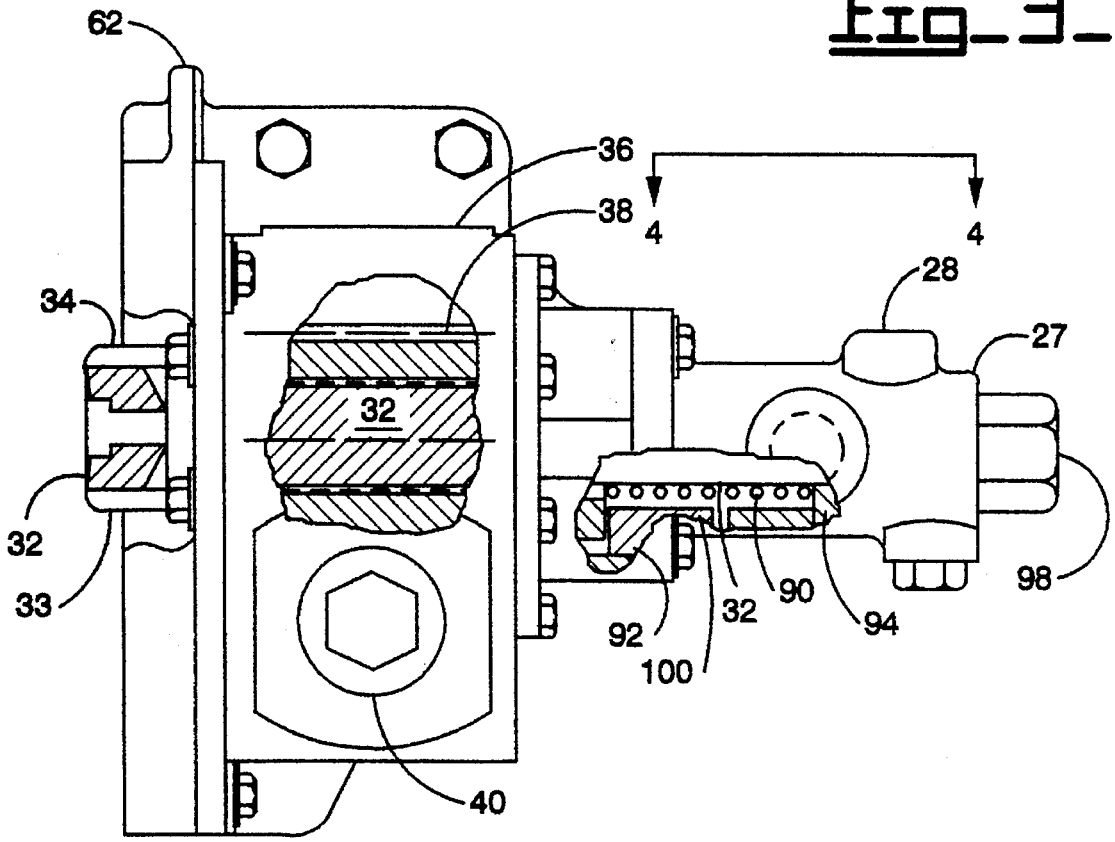
FIG. 3 is a partial cross-sectional view of the engine barring system of FIG. 1 taken in the direction of the arrows along line 3—3 of FIG. 2.

Referring now to FIGS. 2 and 3, system 10 is shown in greater detail. System 10 includes an engine barring device 27 similar to the engine barring device disclosed in U.S. Pat. No. 4,580,534 issued on Apr. 8, 1986 to Blum et al., the contents of which are hereby incorporated by reference. As such, device 27 comprises generally a housing 28 that includes a bore therein and a drive shaft 32 movably disposed both axially and rotationally within the bore relative to housing 28. Drive shaft 32 includes a gear 33 attached at its engaging end for engaging the flywheel of engine 14. Gear 33 has a plurality of external gear teeth 34 adapted for meshing with corresponding gear teeth 20 of flywheel 18.

Unlike the engine barring device of U.S. Pat. No. 4,580,534, device 27 is not manually powered by the user via a wrench or other turning tool, although a tool engaging portion is retained for system 10 to permit manual wrenching as described hereafter in greater detail. Instead, device 27 is powered by a motor 35 via a reduction gear box 36. In the specific preferred embodiment shown, motor 35 is an electric motor available from Baldor Motors 550 S. Capitol Avenue, Indianapolis, Ind. 46225, part number CM3554-M-17 56C. To provide the high torque and low speed incremental rotation required for drive shaft 32, a reducing gear 38 is splined or otherwise engaged with drive shaft 32 within reduction gear box 36. Reduction gear box 36 further includes a numerically smaller gear (not shown) for meshing with gear 38 in a conventional manner. In one specific embodiment, for example, reduction gear box 36 includes a 90 degree worm gear reduction drive available from Peerless Winsmith Division of UMC Industries, Inc., part number B-926XSFS-064-XFT.

To transmit power between motor 35 and reduction gear box 36, barring system 10 includes coupling means for connecting the output of motor 35 to the input of reduction gear box 36. Although a variety of couplings are contemplated for use as coupling means between motor 35 and reduction gear box 36, including direct coupling of motor 35 to reduction gear box 36, in the preferred embodiment the coupling means includes clutch means to facilitate easy connect and disconnect of barring system 10. In the specific embodiment shown, elastomeric jaw clutches 42 and 44 are provided at either side of a bevel gear drive box 46 to transmit power between motor 35 and gear box 36. In addition to providing further reduction of speed of motor 35, bevel gear drive box 46 permits an alternate power input separate from motor 35. In this specific embodiment, bevel gear drive box 46 alternately receives manual power input via a tool engaging portion 48 similar to that provided as the sole power input in U.S. Pat. No. 4,580,534. As such, should an electric power source be temporarily unavailable, the barring device is still manually actuable through the reduction gear box.

The degree of reduction employed in barring system 10 is a function of the torque and speed required for motor 35 to rotate the crankshaft. In the specific embodiment shown, motor 35 is an electric motor rated at one horsepower at a speed of 1725 rpm (460/3/60-1 HP). Other motor speeds and Power are also contemplated, including but not limited to, a 380/3/50 motor rated at 1 hp. at 1425 rpm. To reduce the motor speed, the bevel gear drive box provides a 1.5 to 1 reduction, and the reduction gear box 36 provides a 50 to 1 reduction. As a result of the two reductions, the drive shaft speed at the flywheel is 23 rpm. The rotational speed of the crankshaft is a function of the numerical gear ratio between gear teeth 34 of pinion 33 and gear teeth 20 of flywheel 18. For most large engines, an overall gear reduction results which provides a reduced rotational speed of crankshaft 12 in the range of about 0.5 rpm to about 1.5 rpm.

Further, the overall gear reduction effectively operates as a locking means by providing a significant torque multiplication to prevent rotation of the drive shaft by the crankshaft. In the above specific example, a torque multiplication of 75 is provided by barring system 10 alone to lock or bar the crankshaft from rotation.

To protect against injury to a user, various guards are employed surrounding the different couplings. In particular, a cylindrical guard 50 extends about tool engaging portion 48 and fastens to bevel gear drive box 46 via fasteners 52. An access panel 53 covers tool engaging portion 48 when not is use. Similarly, a cylindrical guard 54 extends about jaw clutch 44 and fastens to bevel gear drive box 46 via fasteners 58, and a guard 60 extends about jaw clutch 42 and fastens to motor 35. Motor 35 and the various couplings and guards are supported by a mounting bracket 62, which also serves to support reduction gear box 36 and barring device 27 from engine 14.

Figure 5:
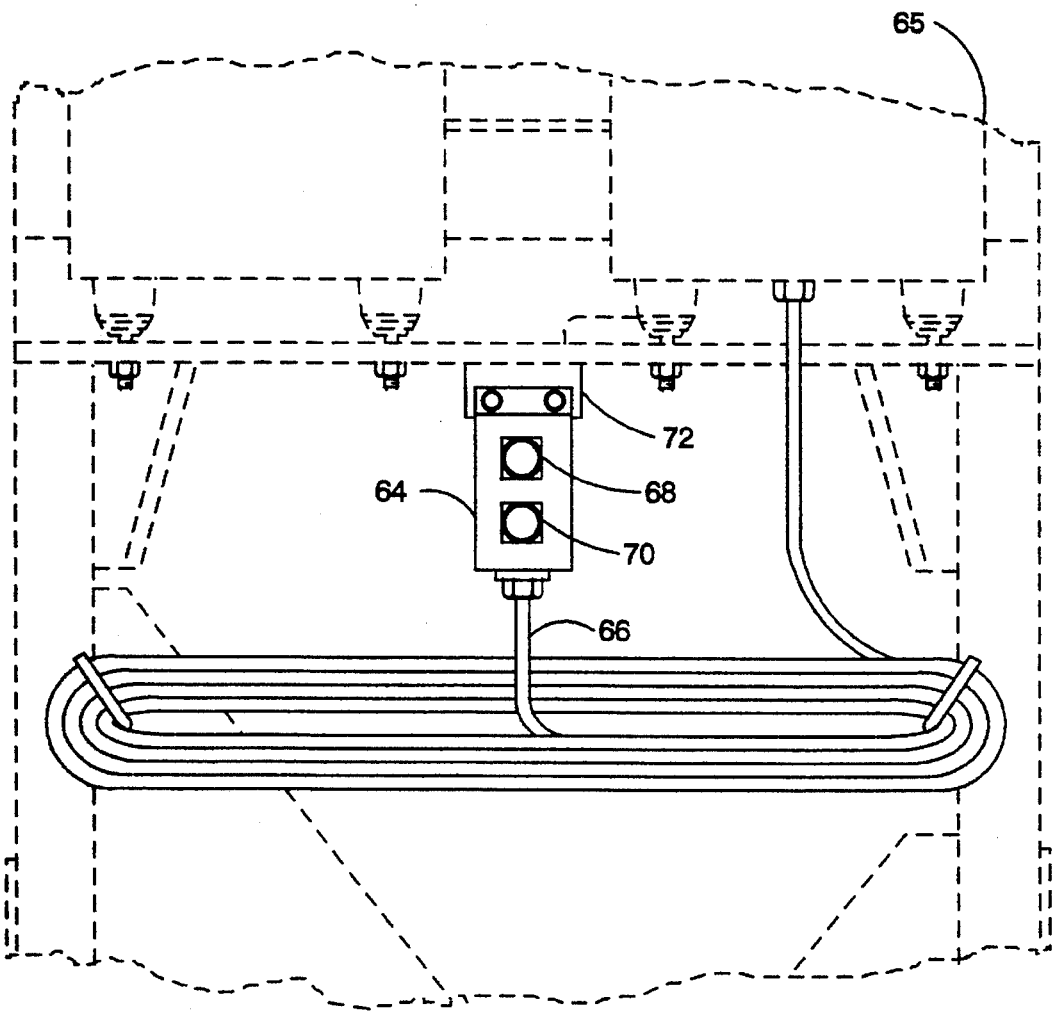
FIG. 5 is a top plan, partial view of the engine barring system of FIG. 1.

Referring now to FIG. 5, to provide remote operation of motor 35 a controller 64 is electronically connected via junction box 65 and cabling 66 to motor 35. The cabling is of sufficient length to permit operation of the motor from anywhere along the length of engine 14. In the specific embodiment shown, cabling 66 is approximately 15 meters (50 feet) in length. Controller 64 supplies either a "forward" signal or a "reverse" signal to motor 35, both signals being selectable by a user via switches 68 and 70. In response to each signal, motor 35 incrementally rotates drive shaft 32 the desired direction via couplings 42 and 44, bevel gear drive box 46, and reduction gear box 36. When not in use, controller 64 is stored seated on a clip 72 attached to bracket 62. Also contemplated is a controller which includes a transmitter in electronic communication with a corresponding receiver of motor 35, thereby eliminating the need for hardwiring the controller to the motor by cabling 66.

Figure 4:
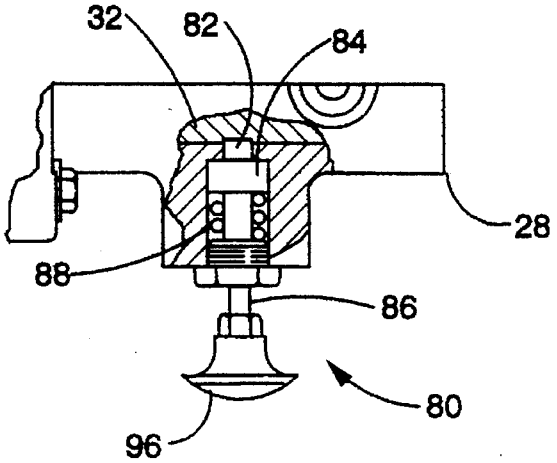
FIG. 4 is a partial cross-sectional view of the engine barring system of FIG. 1 taken in the direction of the arrows along line 4—4 of FIG. 3.

Referring now to FIG. 4, system 10 includes similar driveshaft axial locking and starter bypass features as disclosed in U.S. Pat. No. 4,580,534. In particular, a means 80 for holding shaft 32 at its engaged position with flywheel 18 is provided which leaves drive shaft 32 free for rotational movement. In the specific embodiment shown, the means 80 for holding includes an annular groove 82 located between the ends of the drive shaft and a radial bore 84 located in housing 28 intersecting the axial drive shaft through bore. A rod 86 is slidably located within bore 84 and is adapted to engage with groove 82 when drive shaft 32 is moved to its engaged position. A spring 88 in housing 28 biases rod 86 against drive shaft 32 so that rod 86 automatically engages annular groove 82 when aligned therewith; i.e., when drive shaft 32 is in its engaged position.

Referring back to FIG. 3, drive shaft 32 is normally outwardly biased away from its engaged position by a spring 90. Spring 90 is seated between a stationary member 92 of housing 28 and a movable member 94 attached to shaft 32. As such, spring 90 maintains drive shaft 32 out of engagement with flywheel 18 until force is exerted on the drive shaft at its end 98 urging it into engagement. As drive shaft 32 is axially advanced into engagement, slot 82 of drive shaft 32 aligns with bore 84 at which point rod 86, under bias from spring 88, automatically engages drive shaft 32 to maintain it in engagement with flywheel 18. To disengage drive shaft 32, a handle 96 is provided to pull rod 86 free of drive shaft 32, whereupon drive shaft 32 returns to its disengaged position under the bias force provided by spring 90.

System 10 further includes a means for disabling the starting system should the starting system be actuated during operation of system 10. Similar to the means for disabling described in U.S. Pat. No. 4,580,534, a pair of ports are provided in housing 28 and a 360 degree annular slot is provided in drive shaft 32 in fluid communication with starting system 21. When the drive shaft is disengaged, the 360 degree annular slot is aligned with the pair of ports to communicate compressed air from the air source to the starter motor. When the drive shaft is engaged, the pair of ports are blocked by the drive shaft, thereby interrupting fluid flow to the starter to disable the starter. In the specific preferred embodiment, the compressed air is additionally vented at ports 100 similar to that disclosed in U.S. Pat. No. 4,580,534.

We claim:

1. An engine barring system for use with an engine during maintenance thereof, the engine including a starting system which functions exclusive of the engine barring system, the engine barring system comprising:

a drive shaft including a plurality of gear teeth adapted for meshing with corresponding gear teeth of the engine drive train, said drive shaft being engageable with the engine drive train when the starting system of the engine is disengaged;

motor means for incrementally rotating said drive shaft when said drive shaft is engaged with the engine drive train, said motor means incrementally rotating said drive shaft in response to a first signal; and means for controlling said motor means, said means for controlling supplying said first signal in response to a first manual input by a user.

2. The engine barring system of claim 1, wherein:

said motor means includes forward and reverse speeds, said motor means incrementally rotating said drive shaft at said forward speed in response to said first signal and incrementally rotating said drive shaft at said reverse speed in response to a second signal; and said means for controlling supplies said second signal in response to a second manual input by a user.

3. The engine barring device of claim 2, wherein said means for controlling is remote from said motor means.

4. The engine barring device of claim 3, wherein said means for controlling is a portable hand-held controller electronically connected to said motor means.

5. The engine barring device of claim 4, wherein said portable hand-held controller is electronically connected to said motor means by cabling.

6. The engine barring device of claim 1, wherein said means for controlling is remote from said motor means.

7. In an engine barring device for incrementally rotating a crankshaft of an engine during engine maintenance, said engine barring device including a drive shaft engageable with a flywheel connected to said crankshaft to rotate said crankshaft, the improvement comprising an electric motor coupled with said drive shaft and a portable electronic controller remote from said electric motor, said electric motor incrementally rotating said drive shaft in response to a signal supplied by said electronic controller.

8. The improvement of claim 7, and further comprising a reduction gear box coupled between said electric motor and said drive shaft.

9. The improvement of claim 8, and further comprising a manual drive input coupled with said reduction gear box.

10. An engine barring system, comprising:

a housing adapted for mounting to an engine;

a drive shaft movably disposed within said housing, said drive shaft being manually movable between an engaged position and a disengaged position for selectable engagement with the drivetrain of the engine during engine maintenance;

a motor coupled to said drive shaft, said motor being adapted for incrementally rotating said drive shaft; and a controller remote from said motor, said controller being adapted for actuating said motor to rotate said drive shaft.

11. The engine barring system of claim 10, wherein:

said motor is an electric motor, said electric motor incrementally rotating said drive shaft at a first speed in response to a first electronic signal; and said controller supplies said first signal in response to a first manual input by a user.

12. The engine barring system of claim 11, wherein:

said electric motor incrementally rotates said drive shaft at a second reverse speed in response to a second electronic signal; and said controller supplies said second electronic signal in response to a second manual input by a user.

13. The engine barring system of claim 11, and further comprising a reduction gear box coupled between said motor and said drive shaft.

14. The engine barring system of claim 13, wherein said reduction gear box includes a first gear coupled to said drive shaft and a second gear coupled to said motor, the axis of said first gear being at a 90 degree angle relative to the axis of said second gear.

15. The engine barring system of claim 13, and further comprising a first clutch coupled between said motor and said reduction gear box.

16. The engine barring system of claim 15, and further comprising:

a power input coupled between said motor and said first clutch; and a second clutch coupled between said motor and said power input.

17. The engine barring system of claim 16, wherein said first clutch and said second clutch are jaw clutches.

18. The engine barring system of claim 17, wherein said first clutch and said second clutch are constructed of an elastomer.

19. The engine barring system of claim 16, and further comprising a manual drive input coupled with said power input.

20. The engine barring system of claim 19, wherein said power input is a bevel gear box.

* * * * *